US007736831B2

(12) United States Patent
Lai et al.

(10) Patent No.: US 7,736,831 B2
(45) Date of Patent: Jun. 15, 2010

(54) EMULSION/AGGREGATION PROCESS USING COALESCENT AID AGENTS

(75) Inventors: Zhen Lai, Webster, NY (US); Richard Fong, Webster, NY (US); Yuhua Tong, Webster, NY (US); Chieh-Min Cheng, Rochester, NY (US); Amy A. Grillo, Rochester, NY (US); Paul F. Smith, Oakville (CA); Paul J. Gerroir, Oakville (CA); Beng S. Ong, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 950 days.

(21) Appl. No.: 11/530,079

(22) Filed: Sep. 8, 2006

(65) Prior Publication Data

US 2008/0063965 A1 Mar. 13, 2008

(51) Int. Cl.
*G03G 9/087* (2006.01)

(52) U.S. Cl. ..... 430/137.14; 430/108.1

(58) Field of Classification Search ..... None
See application file for complete search history.

(56) References Cited

U.S. PATENT DOCUMENTS 3,847,604 A 11/1974 Hagenbach et al.
4,338,390 A 7/1982 Lu
4,935,326 A 6/1990 Creatura et al.
4,937,166 A 6/1990 Creatura et al.
5,278,020 A 1/1994 Grushkin et al.
5,290,654 A 3/1994 Sacripante et al.
5,308,734 A 5/1994 Sacripante et al.
5,344,738 A 9/1994 Kmiecik-Lawrynowicz et al.
5,346,797 A 9/1994 Kmiecik-Lawrynowicz et al.
5,348,832 A 9/1994 Sacripante et al.
5,364,729 A 11/1994 Kmiecik-Lawrynowicz et al.
5,366,841 A 11/1994 Patel et al.
5,370,963 A 12/1994 Patel et al.
5,403,693 A 4/1995 Patel et al.
5,405,728 A 4/1995 Hopper et al.
5,418,108 A 5/1995 Kmiecik-Lawrynowicz et al.
5,496,676 A 3/1996 Croucher et al.
5,501,935 A 3/1996 Patel et al.
5,527,658 A 6/1996 Hopper et al.
5,585,215 A 12/1996 Ong et al.
5,650,255 A 7/1997 Ng et al.
5,650,256 A 7/1997 Veregin et al.
5,723,253 A 3/1998 Higashino et al.
5,744,520 A 4/1998 Kmiecik-Lawrynowicz et al.
5,747,215 A 5/1998 Ong et al.
5,763,133 A 6/1998 Ong et al.
5,766,818 A 6/1998 Smith et al.
5,804,349 A 9/1998 Ong et al.
5,827,633 A 10/1998 Ong et al.
5,840,462 A 11/1998 Foucher et al.
5,853,944 A 12/1998 Foucher et al.
5,863,698 A 1/1999 Patel et al.
5,869,215 A 2/1999 Ong et al.
5,902,710 A 5/1999 Ong et al.
5,910,387 A 6/1999 Mychajlowskij et al.
5,916,725 A 6/1999 Patel et al.
5,919,595 A 7/1999 Mychajlowskij et al.
5,922,501 A 7/1999 Cheng et al.
5,925,488 A 7/1999 Patel et al.
5,945,245 A 8/1999 Mychajlowskij et al.
5,977,210 A 11/1999 Patel et al.
5,994,020 A 11/1999 Patel et al.
6,132,924 A 10/2000 Patel et al.
6,268,102 B1 7/2001 Hopper et al.
6,395,442 B1 5/2002 Hayashi et al.
6,416,920 B1 7/2002 Hopper et al.
6,472,117 B1 10/2002 Kohyama et al.
6,495,302 B1 12/2002 Jiang et al.
6,500,597 B1 12/2002 Patel et al.
6,541,175 B1 4/2003 Jiang et al.
6,576,389 B2 6/2003 Vanbesien et al.
6,602,644 B2 8/2003 Matsushima et al.
6,617,091 B2 * 9/2003 Nishimori et al. ..... 430/137.11
6,617,092 B1 9/2003 Patel et al.
6,627,373 B1 9/2003 Patel et al.
6,638,677 B2 10/2003 Patel et al.
6,656,657 B2 12/2003 Patel et al.
6,656,658 B2 12/2003 Patel et al.
6,664,017 B1 12/2003 Patel et al.
6,673,505 B2 1/2004 Jiang et al.
6,677,097 B2 1/2004 Ohmura et al.
2004/0152007 A1 8/2004 Combes et al.
2005/0181296 A1 * 8/2005 Robinson et al. ..... 430/137.14

* cited by examiner

*Primary Examiner*—John L Goodrow
(74) *Attorney, Agent, or Firm*—Oliff & Berridge, PLC

(57) ABSTRACT

A process for preparing a toner includes mixing a polymeric resin emulsion, a colorant dispersion, and a wax to form a mixture; optionally adding a coagulant to the mixture; heating the mixture at a temperature below a glass transition temperature of the polymeric resin to aggregate the polymeric resin, colorant, and wax, to form aggregated particles; adding a coalescent agent to the aggregated particles; heating the aggregated particles and coalescent agent at a temperature above the glass transition temperature of the polymeric resin, to coalesce the aggregated particles to form toner particles, optionally cooling the mixture, and isolating the tone particles.

23 Claims, No Drawings

EMULSION/AGGREGATION PROCESS USING COALESCENT AID AGENTS

TECHNICAL FIELD

This disclosure is generally directed to toner processes, and more specifically, emulsion aggregation and coalescence processes, as well as toner compositions formed by such processes. More specifically, this disclosure is directed to methods for the preparation of toner compositions by a chemical process, such as emulsion aggregation, wherein the resultant toner composition is provided in a shorter time, under a lower process temperature, and with improved spheridization. The process generally comprises aggregating latex particles, such as latexes containing poly (styrene-co-n-butyl acrylate), polyester or sulfonated polyester polymeric particles, with a wax and a colorant, optionally in the presence of a coagulant, followed by adding a coalescent agent prior to a coalescence step.

RELATED APPLICATIONS

Illustrated in copending application U.S. Ser. No. 11/380, 302, filed Apr. 26, 2006, entitled Toner Compositions and Processes, is a toner composition comprising: toner particles comprising a polymeric resin, a colorant, a wax, and an optional second coagulant; and a first coagulant applied as a surface additive to a surface of said toner particles to alter a triboelectric charge of said toner particles. The toner can be made by a process comprising: mixing a polymeric resin emulsion, a colorant dispersion, and a wax to form a mixture; adding an organic or an inorganic acid to said mixture; optionally adding a second coagulant to said mixture; heating the mixture, permitting aggregation and coalescence of said polymeric resin, colorant, and wax, to form toner particles, optionally cooling the mixture and isolating the toner particles, and adding a first coagulant as a surface additive to a surface of said toner particles to alter a triboelectric charge of said toner particles.

Illustrated in copending application U.S. Ser. No. 11/187, 007, filed Jul. 22, 2005, entitled Emulsion Aggregation Toner, Developer, and Method of Making the Same, is a toner comprising particles of a resin, a colorant, an optional wax, and a polyion coagulant, wherein the toner is prepared by an emulsion aggregation process. In embodiments, the resin is polyester resin, such as a sulfonated polyester resin. The toner can be made by a process comprising: mixing a resin emulsion, a colorant dispersion, and an optional wax to form a mixture; adding an organic or an inorganic acid to the mixture; adding a polyion coagulant to the mixture; heating the mixture, permitting aggregation and coalescence of the resin and colorant, and optionally cooling the mixture and isolating the product, wherein the polyion coagulant is added to the mixture at least one of before or during the heating.

Illustrated in copending application U.S. Ser. No. 11/003, 581, filed Dec. 3, 2004, entitled Toner Compositions, is a toner composition comprising: a resin substantially free of cross linking; a cross linked resin; a wax; and a colorant. For example, the application illustrates a toner process comprising: mixing a resin substantially free of cross linking and a cross linked resin in the presence of a wax, a colorant, and a coagulant to provide toner size aggregates; adding additional resin substantially free of cross linking to the formed aggregates thereby providing a shell over the formed aggregates; heating the shell covered aggregates to form toner; and optionally, isolating the toner.

Illustrated in copending application U.S. Ser. No. 11/044, 847, filed Jan. 27, 2005, entitled Hybrid Toner Processes, is a toner process comprised of a first heating of a colorant dispersion, a first latex emulsion, a second latex emulsion, and a wax dispersion in the presence of a coagulant containing a metal ion; adding a third latex; adding an organic sequestering compound or a silicate salt sequestering compound, followed by a second heating wherein the first heating is accomplished at below about the first latex polymer glass transition temperature, and the second heating is above about the first latex polymer glass transition temperature, and wherein the first latex and the third latex are free of a polyester, and the second latex contains a polyester.

Illustrated in copending application U.S. Ser. No. 10/948, 450, filed Sep. 23, 2004, entitled Low Melt Toners and Processes Thereof, is a process for preparing a low-melt toner, the process comprising: forming a pre-toner mixture comprising a first alkali sulfonated polyester resin, a second alkali sulfonated polyester resin and a colorant; adding an aggregating agent to the pre-toner mixture and aggregating the mixture to form an aggregate mix comprising a plurality of aggregate toner particles; coalescing the aggregate mix at a temperature of from about 5 to about 20° C. above the glass transition temperature ($T_g$) of one of the first or second alkali sulfonated polyester resins to form a mixture of coalesced toner particles; and cooling the mixture of coalesced toner particles.

Illustrated in copending application U.S. Ser. No. 10/606, 330, filed Jun. 25, 2003, entitled Toner Processes, is a toner process comprised of heating a mixture of an acicular magnetite dispersion, a colorant dispersion, a wax dispersion, a first latex containing a crosslinked resin, and a second latex containing a resin free of crosslinking in the presence of a coagulant to provide aggregates, stabilizing the aggregates with a silicate salt dissolved in a base, and further heating the aggregates to provide coalesced toner particles.

Illustrated in copending application U.S. Ser. No. 10/606, 298, filed Jun. 25, 2003, entitled Toner Processes, is a toner process comprised of a first heating of a mixture of an aqueous colorant dispersion, an aqueous latex emulsion, and an aqueous wax dispersion in the presence of a coagulant to provide aggregates, adding a base followed by adding an organic sequestering agent, and thereafter accomplishing a second heating, and wherein the first heating is below about the latex polymer glass transition temperature (Tg), and the second heating is about above the latex polymer glass transition temperature.

Illustrated in copending application U.S. Ser. No. 10/603, 449, filed Jun. 25, 2003, entitled Toner Processes, is a toner process comprised of a first heating of a colorant dispersion, a latex emulsion, and a wax dispersion in the presence of a coagulant containing a metal ion; adding a silicate salt; followed by a second heating.

Illustrated in U.S. Pat. No. 6,576,389, filed Oct. 15, 2001 on Toner Coagulant Processes, is a process for the preparation of toner comprising mixing a colorant dispersion, a latex emulsion, a wax dispersion and coagulants comprising a colloidal alumina coated silica, and a polymetal halide.

The appropriate components, such as for example, waxes, coagulants, resin latexes, surfactants, and colorants, and processes of the above copending applications and patents may be selected for the present disclosure in embodiments thereof.

The entire disclosures of the above-mentioned applications are totally incorporated herein by reference.

BACKGROUND

Illustrated herein in embodiments are toner processes, and more specifically, emulsion aggregation and coalescence processes. More specifically, disclosed in embodiments are methods for the preparation of toner compositions by a chemical process, such as emulsion aggregation, wherein latex particles (for example polystyrene-acrylates latexes or latexes containing crystalline or amorphous polymeric particles such as polyester or sulfonated polyester), are aggregated with a wax and a colorant. Optionally, the latex particles are aggregated in the presence of a coagulant. This is followed by adding a coalescent agent (optionally with adding a latex containing further polymeric particles), prior to a coalescence step. Thereafter, the aggregates are stabilized. This procedure is followed by coalescing or fusing the aggregates such as by heating the mixture above the resin Tg so as to provide toner size particles.

A number of advantages are associated with the toner obtained by the processes illustrated herein. For example, the processes, in embodiments, provide toner particles having improved spheridization, that is an increasingly rounder shape. Moreover, the processes, in embodiments, allow the toner composition to be provided in a shorter time, and under a lower process (coalescence) temperature.

The processes of the disclosure, in embodiments, allow toner compositions to be made faster and at lower temperature, which provides both time and cost savings. In addition, the toner particles, in embodiments, are increasingly better rounded and thus provide more uniform desired properties.

REFERENCES

In U.S. Pat. No. 6,677,097, there is illustrated a toner for developing a static image comprising at least a resin, colorant and crystalline substance. The toner particle has a domain-matrix structure and the domain has an average of the ratio of the major axis to the minor axis of from 1.5 to 2.5 when the domain is approximated by an ellipse.

In U.S. Pat. No. 6,602,644, there is illustrated a toner for developing an electrostatic latent image. The toner comprises a resin, a colorant and a releasing agent or a crystalline polyester compound, and the toner has crushability index from 0.1 to 0.8. The toner is preferably produced by sat-out/fusion-adherence of a composite resin particle and a colorant particle, the composite resin particle comprises polyester compound in a portion of the composite resin particle other than outermost layer.

In U.S. Pat. No. 6,617,091, there is illustrated a method of preparing toner for developing an electrostatic image. The method comprises process for adhering by fusing resin particles onto surface of colored particles (core particles) containing a resin particle and a colorant by salting-out/fusion-adhering to form the resin layer (shell).

In U.S. Pat. No. 6,472,117, there is illustrated a toner for developing an electrostatic image comprising a resin, a colorant and a releasing agent in which the toner particles are obtained by salting out/fusion-adhering a resin particle comprising a binding resin and a releasing agent together with a colorant particle. The toner comprises the toner particles having a variation coefficient of the number particle size distribution of not more than 27 percent.

In U.S. Pat. No. 6,395,442, there is illustrated a toner for electrophotography. The resin binder is obtained by fusing fine resin particles comprising a crystalline material and amorphous polymer in a water-based medium. The crystalline material preferably has a melting point of 60 to 130° C., a number average molecular weight of 1,500 to 15,000, and a melt viscosity at the melting point +20° C. of not more than 100 Pa·s, and the amorphous polymer is preferably composed of a radically polymerizable monomer.

In U.S. Pat. No. 6,268,102, there is illustrated a process for the preparation of toner comprising mixing a colorant a latex, and a coagulant, followed by aggregation and coalescence, wherein the coagulant may be a polyaluminum sulfosilicate.

In U.S. Pat. No. 6,132,924, there is illustrated a process for the preparation of toner comprising mixing a colorant, a latex, and two coagulants, followed by aggregation and coalescence, and wherein one of the coagulants may be polyaluminum chloride.

Illustrated in U.S. Pat. No. 5,994,020, are toner preparation processes, and more specifically, a process for the preparation of toner comprising:

(i) preparing, or providing a colorant dispersion;

(ii) preparing, or providing a functionalized wax dispersion comprised of a functionalized wax contained in a dispersant mixture comprised of a nonionic surfactant, an ionic surfactant, or mixtures thereof;

(iii) shearing the resulting mixture of the functionalized wax dispersion (ii) and the colorant dispersion (i) with a latex or emulsion blend comprised of resin contained in a mixture of an anionic surfactant and a nonionic surfactant;

(iv) heating the resulting sheared blend of (iii) below about the glass transition temperature (Tg) of the resin particles;

(v) optionally adding additional anionic surfactant to the resulting aggregated suspension of (iv) to prevent, or minimize additional particle growth of the resulting electrostatically bound toner size aggregates during coalescence (iv);

(vi) heating the resulting mixture of (v) above about the Tg of the resin; and optionally, (vii) separating the toner particles; and a process for the preparation of toner comprising blending a latex emulsion containing resin, colorant, and a polymeric additive; adding an acid to achieve a pH of about 2 to about 4 for the resulting mixture; heating at a temperature about equal to, or about below the glass transition temperature (Tg) of the latex resin; optionally adding an ionic surfactant stabilizer; heating at a temperature about equal to, or about above about the Tg of the latex resin; and optionally cooling, isolating, washing, and drying the toner.

Illustrated in U.S. Pat. No. 6,541,175, is a process comprising:

(i) providing or generating an emulsion latex comprised of sodio sulfonated polyester resin particles by heating the particles in water at a temperature of from about 65° C. to about 90° C.;

(ii) adding with shearing to the latex (i) a colorant dispersion comprising from about 20 percent to about 50 percent of a predispersed colorant in water, followed by the addition of an organic or an inorganic acid;

(iii) heating the resulting mixture at a temperature of from about 45° C. to about 65° C. followed by the addition of a water insoluble metal salt or a water insoluble metal oxide thereby releasing metal ions and permitting aggregation and coalescence, optionally resulting in toner particles of from about 2 to about 25 microns in volume average diameter; and optionally (iv) cooling the mixture and isolating the product.

Also of interest is U.S. Pat. No. 6,416,920, which illustrates a process for the preparation of toner comprising mixing a colorant, a latex, and a silica, which silica is coated with an alumina.

Illustrated in U.S. Pat. No. 6,495,302, is a process for the preparation of toner comprising (i) generating a latex emulsion of resin, water, and an ionic surfactant, and a colorant dispersion of a pigment, water, an ionic surfactant, or a nonionic surfactant, and wherein (ii) the latex emulsion is blended with the colorant dispersion;

(iii) adding to the resulting blend containing the latex and colorant a coagulant of a polyaluminum chloride with an opposite charge to that of the ionic surfactant latex colorant;

(iv) heating the resulting mixture below or equal to about the glass transition temperature (Tg) of the latex resin to form aggregates;

(v) optionally adding a second latex comprised of submicron resin particles suspended in an aqueous phase (iv) resulting in a shell or coating wherein the shell is optionally of from about 0.1 to about 1 micron in thickness, and wherein optionally the shell coating is contained on 100 percent of the aggregates;

(vi) adding an organic water soluble or water insoluble chelating component to the aggregates of (v) particles, followed by adding a base to change the resulting toner aggregate mixture from a pH which is initially from about 1.9 to about 3 to a pH of about 5 to about 9;

(vii) heating the resulting aggregate suspension of (vi) above about the Tg of the latex resin;

(viii) optionally retaining the mixture (vii) at a temperature of from about 70° C. to about 95° C.;

(ix) changing the pH of the (viii) mixture by the addition of an acid to arrive at a pH of about 1.7 to about 4; and (x) optionally isolating the toner.

Illustrated in U.S. Pat. No. 6,500,597, is a process comprising (i) blending a colorant dispersion of a pigment, water, and an anionic surfactant, or a nonionic surfactant with (ii) a latex emulsion comprised of resin, water, and an ionic surfactant;

(iii) adding to the resulting blend a first coagulant of polyaluminum sulfosilicate (PASS) and a second cationic co-coagulant having an opposite charge polarity to that of the latex surfactant;

(iv) heating the resulting mixture below about the glass transition temperature (Tg) of the latex resin;

(v) adjusting with a base the pH of the resulting toner aggregate mixture from a pH which is in the range of about 1.8 to about 3 to a pH range of about 5 to about 9;

(vi) heating above about the Tg of the latex resin;

(vii) changing the pH of the mixture by the addition of a metal salt to arrive at a pH of from about 2.8 to about 5; and (viii) optionally isolating the product.

Emulsion/aggregation/coalescing processes for the preparation of toners are illustrated in a number of Xerox patents, such as U.S. Pat. Nos. 5,290,654, 5,278,020, 5,308,734, 5,370,963, 5,344,738, 5,403,693, 5,418,108, 5,364,729, and 5,346,797; and also of interest may be U.S. Pat. Nos. 5,348,832; 5,405,728; 5,366,841; 5,496,676; 5,527,658; 5,585,215; 5,650,255; 5,650,256 5,501,935; 5,723,253; 5,744,520; 5,763,133; 5,766,818; 5,747,215; 5,827,633; 5,853,944; 5,804,349; 5,840,462; 5,869,215; 5,869,215; 5,863,698; 5,902,710; 5,910,387; 5,916,725; 5,919,595; 5,925,488 and 5,977,210.

In addition, the following U.S. Patents relate to emulsion aggregation toner processes.

U.S. Pat. No. 5,922,501, illustrates a process for the preparation of toner comprising blending an aqueous colorant dispersion and a latex resin emulsion, and which latex resin is generated from a dimeric acrylic acid, an oligomer acrylic acid, or mixtures thereof and a monomer; heating the resulting mixture at a temperature about equal, or below about the glass transition temperature (Tg) of the latex resin to form aggregates; heating the resulting aggregates at a temperature about equal to, or above about the Tg of the latex resin to effect coalescence and fusing of the aggregates; and optionally isolating the toner product, washing, and drying.

U.S. Pat. No. 5,945,245, illustrates a surfactant free process for the preparation of toner comprising heating a mixture of an emulsion latex, a colorant, and an organic complexing agent.

The disclosures of each of the foregoing patents and publications are hereby incorporated by reference herein in their entireties. The appropriate components and process aspects of the each of the foregoing patents and publications may also be selected for the present compositions and processes in embodiments thereof.

SUMMARY

A toner composition and a process for preparing a toner including, for example, an emulsion aggregation process for preparing a toner, are described. The toner composition comprises, for example, particles of a resin such as a polyester resin, a colorant, a wax, and optionally a coagulant such as a monovalent metal, divalent metal, or polyion coagulant, wherein the toner is prepared by an emulsion aggregation process. The resin can be a crystalline or an amorphous polymeric resin, or a mixture thereof.

A process for preparing a toner comprises, for example, mixing a resin such as a polyester resin with a wax, a colorant, and optionally a coagulant to provide toner size aggregates; optionally adding additional resin to the formed aggregates thereby providing a shell, having a thickness of for example about 0.1 to about 2 or about 5 microns, such as about 0.3 to about 0.8 micrometers, over the formed aggregates; adding a coalescent agent prior to a coalescence step, thereafter stabilizing the aggregates and coalescing or fusing the aggregates by heating the mixture above the resin Tg to provide toner size particles; and, optionally, isolating the toner. In embodiments, the heating comprises a first heating below the glass transition temperature of the resin substantially free of cross-linking and a second heating above the glass transition temperature of the resin substantially free of cross linking. In embodiments, the first heating is accomplished before addition of the coalescent agent, and the second hearting occurs after addition of the coalescent agent. In embodiments, the toner process provides toner particles having a desired round or spherical shape, and the toner is produced in a relatively shorter time and at a relatively lower process temperature.

In an embodiment, the present disclosure provides a process for preparing a toner, comprising:

mixing a polymeric resin emulsion, a colorant dispersion, and a wax to form a mixture;

optionally adding a coagulant to said mixture;

heating the mixture at a temperature below a glass transition temperature of said polymeric resin to aggregate said polymeric resin, colorant, and wax, to form aggregated particles;

adding a coalescent agent to said aggregated particles;

heating the aggregated particles and coalescent agent at a temperature above the glass transition temperature of said polymeric resin, to coalesce said aggregated particles to form toner particles, optionally cooling the mixture; and isolating the toner particles.

EMBODIMENTS

The toner of the present disclosure is comprised of toner particles comprised of at least a latex emulsion polymer resin such as a polyester polymer resin, a wax, a colorant, and an optional coagulant. The formed toner particles further comprise a coalescent agent incorporated into the toner particles during a coalescence step. The toner particles may also include other conventional optional additives, such as colloidal silica (as a flow agent) and the like.

The specific latex for resin, polymer or polymers selected for the toner of the present disclosure include polyester and/or its derivatives, including polyester resins and branched polyester resins, polyimide resins, branched polyimide resins, poly (styrene-acrylate) resins, crosslinked poly(styrene-acrylate) resins, poly(styrene-methacrylate) resins, crosslinked poly(styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-poly(styrene-butadiene) resins, crosslinked alkali sulfonated poly(styrene-butadiene) resins, and the like. In an embodiment, for example, a particularly desirable resin is a polyester, such as a sulfonated polyester.

Illustrative examples of polymer resins selected for the process and particles of the present disclosure include any of the various polyesters, such as polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-sebacate, polypropylene sebacate, polybutylene-sebacate, polyethylene-adipate, polypropylene-adipate, polybutylene-adipate, polypentylene-adipate, polyhexalene-adipate, polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate polyethylene-pimelate, polypropylene-pimelate, polybutylene-pimelate, polypentylene-pimelate, polyhexalene-pimelate, polyheptadene-pimelate, poly(propoxylated bisphenol-fumarate), poly(propoxylated bisphenol-succinate), poly (propoxylated bisphenol-adipate), poly(propoxylated bisphenol-glutarate), SPAR™ (Dixie Chemicals), BECKOSOL™ (Reichhold Chemical Inc), ARAKOTE™ (Ciba-Geigy Corporation), HETRON™ (Ashland Chemical), PARAPLEX™ (Rohm & Hass), POLYLITE™ (Reichhold Chemical Inc), PLASTHALL™ (Rohm & Hass), CYGAL™ (American Cyanamide), ARMCO™ (Armco Composites), ARPOL™ (Ashland Chemical), CELANEX™ (Celanese Eng), RYNITE™ (DuPont), STYPOL™ (Freeman Chemical Corporation) mixtures thereof and the like. The resins can also be functionalized, such as carboxylated, sulfonated, or the like, and particularly such as sodio sulfonated, if desired.

In embodiments, a sulfonated polyester resin such as a sodio sulfonated polyester resin is used in the toner particles. When used, the sulfonated polyester resin can have any desired degree of sulfonation. For example, the sulfonation degree can be from about 0.1 to about 15 percent or to about 20 percent, such as from about 0.3 to about 6 percent.

The latex polymer of embodiments can be either crystalline, amorphous, or a mixture thereof. Thus, for example, the toner particles can be comprised of crystalline latex polymer, amorphous latex polymer, or a mixture of two or more latex polymers where one or more latex polymer is crystalline and one or more latex polymer is amorphous.

The crystalline resins, which are available from a number of sources, can be prepared by a polycondensation process by reacting an organic diol, and an organic diacid in the presence of a polycondensation catalyst. Generally, a stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and can be selected in an amount, for example, of from about 0.01 to about 1 mole percent of the resin. Additionally, in place of the organic diacid, an organic diester can also be selected, and where an alcohol byproduct is generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline polyester resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfoaliphatic diacid can be selected in an amount of from about 1 to about 10 mole percent of the resin. There can be selected for the third latex branched amorphous resin an alkali sulfonated polyester resin. Examples of suitable alkali sulfonated polyester resins include, the metal or alkali salts of copoly(ethylene-terephthalate)-copoly-(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(propylene-butylene-terephthalate)-copoly(propylene-butylene-5-sulfo-isophthalate), copoly-(propoxylated bisphenol-A-fumarate)-copoly(propoxylated bisphenol-A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), and wherein the alkali metal is, for example, a sodium, lithium or potassium ion.

Examples of crystalline based polyester resins include alkali copoly(5-sulfo-isophthaloyl)-co-poly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly (pentylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly (propylene-adipate), alkali copoly(5-sulfo-isophthaloyl)-co-poly(butylene-adipate), alkali copoly(5-sulfo-isophthaloyl)-copoly(pentylene-adipate), alkali copoly(5-sulfo-isopthaloyl)-copoly(hexylene-adipate), alkali copoly(5-sulfo-isophthaloyl)-copoly(octylene-adipate), alkali copoly(5-sulfo-isophthaloyl)-copoly (ethylene-succinate), alkali copoly(5-sulfo-isophthaloyl-copoly(butylene-succinate), alkali copoly(5-sulfo-isophthaloyl)-copoly(hexylene-succinate), alkali copoly(5-sulfo-isophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly (hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), poly(octylene-adipate); and wherein alkali is a metal of sodium, lithium or potassium, and the like. In embodiments, the alkali metal is lithium.

The latex polymer may be present in an amount of from about 70 to about 95% by weight of the toner particles (i.e., toner particles exclusive of external additives) on a solids basis, such as from about 75 to about 85% by weight of the toner. However, amounts outside of these ranges can be used, in embodiments, depending upon the type and amounts of other materials present.

The monomers used in making the selected polymer are not limited, and the monomers utilized may include any one or more of, for example, ethylene, propylene, and the like. Known chain transfer agents, for example dodecanethiol or carbon tetrabromide, can be utilized to control the molecular weight properties of the polymer. Any suitable method for forming the latex polymer from the monomers may be used without restriction.

The polyester resin latex or emulsion can be prepared by any suitable means. For example, the latex or emulsion can be prepared by taking the resin and heating it to its melting temperature and dispersing the resin in an aqueous phase containing a surfactant. The dispersion can be carried out by various dispersing equipment such as ultimizer, high speed homogenizer, or the like to provide submicron resin particles. Other ways to prepare the polyester resin latex or emulsion include solubilizing the resin in a solvent and adding it to heated water to flash evaporate the solvent. External dispersion can also be employed to assist the formation of emulsion as the solvent is being evaporated. Polyester resin emulsions prepared by other means or methods can also be utilized in the preparation of the toner composition.

The polyester resin, such as crystalline polyester resin, can possess various melting points of, for example, from about 30° C. to about 120° C., or from about 35° C. to about 90° C. such as from about 40° C. to about 80° C. The polyester resin may have, for example, a number average molecular weight ($M_n$), as measured by gel permeation chromatography (GPC) of from about 1,000 to about 50,000, or from about 2,000 to about 25,000. The weight average molecular weight ($M_w$) of the crystalline polyester resin may be, for example, from about 2,000 to about 100,000, and from about 3,000 to about 80,000, as determined by gel permeation chromatography using polystyrene standards. The molecular weight distribution ($M_w/M_n$) of the crystalline polyester resin may be, for example, from about 2 to about 6, and more specifically, from about 2 to about 4.

The polyester resin particles in embodiments have an average particle diameter in the range of about 0.01 to about 10 microns, such as from about 0.1 to about 0.3 microns.

The polyester resin latex in embodiments is present in an amount of from about 5 to about 50 percent by weight of toner latex, such as from about 10 to about 30 percent or about 15% by weight of toner latex. However, amounts outside these ranges can be used.

In addition to the latex polymer binder, the toners of the present disclosure also contain a wax, typically provided in a wax dispersion, which wax dispersion can be of a single type of wax or a mixture of two or more preferably different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

When a wax dispersion is used, the wax dispersion can include any of the various waxes conventionally used in emulsion aggregation toner compositions. Suitable examples of waxes include polyethylene, polypropylene, polyethylene/amide, polyethylenetetrafluoroethylene, and polyethylene-tetrafluoroethylene/amide. Other examples include, for example, polyolefin waxes, such as polyethylene waxes, including linear polyethylene waxes and branched polyethylene waxes, and polypropylene waxes, including linear polypropylene waxes and branched polypropylene waxes; paraffin waxes; Fischer-Tropsch waxes; amine waxes; silicone waxes; mercapto waxes; polyester waxes; urethane waxes; modified polyolefin waxes (e.g., a carboxylic acid-terminated polyethylene wax or a carboxylic acid-terminated polypropylene wax); amide waxes, such as aliphatic polar amide functionalized waxes; aliphatic waxes consisting of esters of hydroxylated unsaturated fatty acids; high acid waxes, such as high acid montan waxes; microcrystalline waxes, such as waxes derived from distillation of crude oil; and the like. By "high acid waxes" it is meant a wax material that has a high acid content. The waxes can be crystalline or non-crystalline, as desired, although crystalline waxes are preferred, in embodiments. By "crystalline polymeric waxes"

it is meant that a wax material contains an ordered array of polymer chains within a polymer matrix that can be characterized by a crystalline melting point transition temperature, Tm. The crystalline melting temperature is the melting temperature of the crystalline domains of a polymer sample. This is in contrast to the glass transition temperature, Tg, which characterizes the temperature at which polymer chains begin to flow for the amorphous regions within a polymer.

To incorporate the wax into the toner, it is desirable for the wax to be in the form of one or more aqueous emulsions or dispersions of solid wax in water, where the solid wax particle size is usually in the range of from about 100 to about 500 nm.

The toners may contain the wax in any amount of from, for example, about 3 to about 15% by weight of the toner, on a dry basis. For example, the toners can contain from about 5 to about 11% by weight of the wax.

The toners also contain at least one colorant. For example, colorants or pigments as used herein include pigment, dye, mixtures of pigment and dye, mixtures of pigments, mixtures of dyes, and the like. For simplicity, the term "colorant" as used herein is meant to encompass such colorants, dyes, pigments, and mixtures, unless specified as a particular pigment or other colorant component. In embodiments, the colorant comprises a pigment, a dye, mixtures thereof, carbon black, magnetite, black, cyan, magenta, yellow, red, green, blue, brown, mixtures thereof, in an amount of about 1% to about 25% by weight based upon the total weight of the composition. It is to be understood that other useful colorants will become readily apparent based on the present disclosures.

In general, useful colorants include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF) and particularly carbon blacks such as REGAL 330 (Cabot), Carbon Black 5250 and 5750 (Columbian Chemicals), and the like or mixtures thereof.

Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like or mixtures thereof. Other useful water based colorant dispersions include those commercially available from Clariant, for example, HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta EO2 which can be dispersed in water and/or surfactant prior to use.

Other useful colorants include, for example, magnetites, such as Mobay magnetites M08029, M08960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like or mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like or mixtures thereof. Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components may also be selected as pigments.

The colorant, such as carbon black, cyan, magenta and/or yellow colorant, is incorporated in an amount sufficient to impart the desired color to the toner. In general, pigment or dye is employed in an amount ranging from about 1% to about 35% by weight of the toner particles on a solids basis, such as from about 5% to about 25% by weight or from about 5 to about 15% by weight. However, amounts outside these ranges can also be used, in embodiments.

The toners of the present disclosure may also contain a coagulant, such as a monovalent metal coagulant, a divalent metal coagulant, a polyion coagulant, or the like. A variety of coagulants are known in the art, as described above. As used herein, "polyion coagulant" refers to a coagulant that is a salt or oxide, such as a metal salt or metal oxide, formed from a metal species having a valence of at least 3, and desirably at least 4 or 5. Suitable coagulants thus include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, and the like. Other suitable coagulants include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds in embodiments have from about 2 to about 13, such as from about 3 to about 8, aluminum ions present in the compound.

Such coagulants can be incorporated into the toner particles during particle aggregation. As such, the coagulant can be present in the toner particles, exclusive of external additives and on a dry weight basis, in amounts of from 0 to about 5% by weight of the toner particles, such as from about greater than 0 to about 3% by weight of the toner particles.

The toner may also include additional known positive or negative charge additives in effective suitable amounts of, for example, from about 0.1 to about 5 weight percent of the toner, such as quaternary ammonium compounds inclusive of alkyl pyridinium halides, bisulfates, organic sulfate and sulfonate compositions such as disclosed in U.S. Pat. No. 4,338,390, cetyl pyridinium tetrafluoroborates, distearyl dimethyl ammonium methyl sulfate, aluminum salts or complexes, and the like.

Also, in preparing the toner by the emulsion aggregation procedure, one or more surfactants may be used in the process. Suitable surfactants include anionic, cationic and nonionic surfactants. In embodiments, the use of anionic and nonionic surfactants are preferred to help stabilize the aggregation process in the presence of the coagulant, which otherwise could lead to aggregation instability.

Anionic surfactants include sodium dodecylsulfate (SDS), sodium dodecyl benzene sulfonate, sodium dodecylnaphthalene sulfate, dialkyl benzenealkyl, sulfates and sulfonates, abitic acid, and the NEOGEN brand of anionic surfactants. An example of a suitable anionic surfactant is NEOGEN RK available from Daiichi Kogyo Seiyaku Co. Ltd., or TAYCA POWER BN2060 from Tayca Corporation (Japan), which consists primarily of branched sodium dodecyl benzene sulphonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quatemized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, and the like. An example of a suitable cationic surfactant is SANISOL B-50 available from Kao Corp., which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc Inc. as IGEPAL CA-210, IGEPAL CA-520, IGEPAL CA-720, IGEPAL CO-890, IGEPAL CO-720, IGEPAL CO-290, IGEPAL CA-210, ANTAROX 890 and ANTAROX 897. An example of a suitable nonionic surfactant is ANTAROX 897 available from Rhone-Poulenc Inc., which consists primarily of alkyl phenol ethoxylate.

Examples of bases used to increase the pH and hence ionize the aggregate particles thereby providing stability and preventing the aggregates from growing in size can be selected from sodium hydroxide, potassium hydroxide, ammonium hydroxide, cesium hydroxide and the like, among others.

Examples of the acids that can be utilized include, for example, nitric acid, sulfuric acid, hydrochloric acid, acetic acid, citric acid, trifluro acetic acid, succinic acid, salicylic acid and the like, and which acids are in embodiments utilized in a diluted form in the range of about 0.5 to about 10 weight percent by weight of water or in the range of about 0.7 to about 5 weight percent by weight of water.

Any suitable emulsion aggregation procedure may be used in forming the emulsion aggregation toner particles without restriction. These procedures typically include the basic process steps of at least aggregating an emulsion containing polymer binder, one or more colorants, one or more waxes, one or more surfactants, an optional coagulant, and one or more additional optional additives to form aggregates, subsequently coalescing or fusing the aggregates, and then recovering, optionally washing and optionally drying the obtained emulsion aggregation toner particles. However, in embodiments, the process is modified by the addition of a coalescent agent (or coalescence aid agent) prior to the coalescence or fusing step. This addition of the coalescent agent provides toner particles having improved spheridization, and allows the coalescence or fusing step to be conducted in a shorter time, at a lower process temperature, or both.

Examples of suitable coalescent agents include, but are not limited to, benzoic acid alkyl esters, ester-alcohols, glycol-ether type solvents, long-chain aliphatic alcohols, aromatic alcohols, mixtures thereof, and the like. Examples of benzoic acid alkyl esters include benzoic acid alkyl esters where the alkyl group, which can be straight or branched, substituted or unsubstituted, has from about 2 to about 30 carbon atoms, such as decyl or isodecyl benzoate, nonyl or isononyl benzoate, octyl or isooctyl benzoate, 2-ethylhexyl benzoate, tridecyl or isotridecyl benzoate, 3,7-dimethyloctyl benzoate, 3,5,5-trimethylhexyl benzoate, mixtures thereof, and the like. Specific commercial examples of such benzoic acid alkyl esters include VELTA® 262 (isodecyl benzoate) and VELTA® 368 (2-ethylhexyl benzoate), available from Vlesicol Chemical Corporation. Examples of ester-alcohols include hydroxyalkyl esters of alkanoic acids where the alkyls group, which can be straight or branched, substituted or unsubstituted, independently have from about 2 to about 30 carbon atoms, such as 2,2,4-trimethylpentane-1,3-diol monoisobutyrate. Specific commercial examples of such ester-alcohols include TEXANOL® (2,2,4-trimethylpentane-1,3-diol monoisobutyrate) available from Eastman Chemical Company. Examples of glycol-ether type solvents include diethylene glycol monomethylether acetate, diethylene glycol monobutylether acetate, butyl carbitol acetate (BCA), and the like. Examples of long-chain aliphatic alcohols include those where the alkyl group is from about 5 to about 20 carbon atoms, such as ethylhexanol, octanol, dodecanol, and the like. Examples of aromatic alcohols include benzyl alcohol, and the like.

In embodiments, the coalescent agents (or coalescence aid agent) are desired to fulfill the following criteria:

(1) sufficiently soften the polymer during the temperature ramp or the early stage of coalescence, so that the individual particles will combine to form a continuous film easily;

(2) the coalescent agent should then evaporate during later stages, so that it does not increase total volatile organic content in the final toner product, and minimizing any impact on the machine performance; and (3) it is desirable that the coalescent agent has very low solubility, such as below about 1.0 or below about 0.5 weight %, below about 0.1 weight %, or below about 0.05 weight %, in water, so that most of them can concentrate inside or on the surfaces of the particles.

Accordingly, in embodiments, the coalescent agent (or coalescence aid agent) evaporates during later stages of the emulsion aggregation process, such as during the second heating step that is generally above the glass transition temperature of the polymeric resin. The final toner particles are thus free of, or essentially or substantially free of, any remaining coalescent agent. To the extent that any remaining coalescent agent may be present in the final toner particles, the amount of remaining coalescent agent is such that it does not affect any properties or performance of the toner.

The coalescent agent can be added prior to the coalescence or fusing step in any desired or suitable amount. For example, the coalescent agent can be added in an amount of from about 0.01 to about 10 percent by weight, based on the solids content in the reaction medium. For example, the coalescent agent can be added in an amount of from about 0.05 or from about 0.1 to about 0.5 or to about 3.0 percent by weight, based on the solids content in the reaction medium. Of course, amounts outside these ranges can be used, as desired. In embodiments, the coalescent agent can be added at any time between aggregation and coalescence, although in embodiments it is desired to add the coalescent agent after aggregation is "frozen" or completed by adjustment of pH by addition, for example, of a base. Adding the coalescent agent after aggregation is "frozen" is desired because it is more efficient than adding the coalescent agent earlier.

Such coalescent agents have been widely used in painting/coating industrial applications. They play most important roles in the film formation of water-based coatings, by increasing the easiness of latex particles to coalescence through softening the latex particles and lowering the minimum film-formation temperature (MFFT) of the latex. Typical latex film formation consists three different stages: (1) waster evaporation brings latex particles into close contact, (2) particles undergo deformation to form a void-free solid structure which is still mechanically weak, and (3) fusion (coalescence) occurs among adjacent particles to give a mechanically strong film.

According to embodiments, the coalescent agents function in a similar manner. In embodiments, the coalescence step of the emulsion aggregation process is similar to a film formation process of latex particles, but without the water evaporation stage. Polymer particles are closely contacted after aggregation and go through the deformation and coalescence (fusion) process at elevated temperature above latex polymer Tg. It has now been found that introducing the coalescent agents into the process, where they had not been included in the past, provides an improved process.

Benefits of the present disclosure include that the coalescence or fusing step can be conducted in a shorter time, at a lower process temperature, or both. For example, while typical emulsion aggregation processes may conduct the coalescent step for about 2 to about 5 hours at a temperature of about 96° C., incorporation of the coalescent agent allows the coalescent step to be conducted for only about one hour at a temperature of about 94° C. For example, in embodiments, the coalescent step can be conducted for only 15 minutes to about 2 hours, such as about 30 minutes to about 90 minutes. Thus, for example, use of the coalescent agent allows the coalescent step to be conducted in half or shorter the amount of time, and at a temperature at least 2° C. lower, than a comparable coalescent process not including the coalescent agent, while still providing the same final product.

Furthermore, addition of the coalescent agent can be incorporated into existing emulsion aggregation processes without any significant process changes, because the addition is conducted during a holding stage between the aggregation step and the coalescent step.

In addition, the resultant toner compositions may have an improved geometric size distribution, or roundness, as compared to prior processes. In embodiments, the toner particles have a very narrow particle size distribution with a lower number ratio geometric standard deviation (GSD) of about 1.15 to about 1.30, or less than about 1.25. The toner particles of the present disclosure also can have a size such that the upper geometric standard deviation (GSD) by volume is from about 1.15 to about 1.30, such as from about 1.18 to about 1.22, or less than about 1.25. These GSD values for the toner particles of the present disclosure indicate that the toner particles are made to have a very narrow particle size distribution.

Suitable emulsion/aggregation/coalescing processes for the preparation of toners, and which can be modified to include a coalescent agent as described herein, are illustrated in a number of Xerox patents, the disclosures of each of which are totally incorporated herein by reference, such as U.S. Pat. Nos. 5,290,654, 5,278,020, 5,308,734, 5,370,963, 5,344,738, 5,403,693, 5,418,108, 5,364,729, and 5,346,797. Also of interest are U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; and 5,977,210, the disclosures of each of which are hereby totally incorporated herein by reference. In addition, Xerox U.S. Pat. Nos. 6,627,373; 6,656,657; 6,617,092; 6,638,677; 6,576,389; 6,664,017; 6,656,658; and 6,673,505 are each hereby totally incorporated herein by reference. The appropriate components and process aspects of each of the foregoing U.S. Patents may be selected for the present composition and process in embodiments thereof.

In embodiments hereof, the toner process comprises forming a toner particle by mixing the polymer latex, in the presence of a wax and a colorant dispersion to which is added an optional coagulant while blending at high speeds such as with a polytron. The resulting mixture having a pH of, for example, about 2.0 to about 3.0 is aggregated by heating to a temperature below the polymer resin Tg to provide toner size aggregates. Optionally, additional latex can be added to the formed aggregates providing a shell over the formed aggregates. The pH of the mixture is then changed, for example by the addition of a sodium hydroxide solution until a pH of about 7.0 is achieved. Following aggregation and base addition, a desired amount of coalescent agent is added to the reaction mixture. The temperature of the mixture is then raised to above the resin Tg, such as to about 95° C. After about 30 minutes, the pH of the mixture is reduced to a value sufficient to coalesce or fuse the aggregates to provide a composite particle upon further heating such as about 4.5. The fused particles can be measured for shape factor or circularity, such as with a Sysmex FPIA 2100 analyzer, until the desired shape is achieved.

The mixture is allowed to cool to room temperature (about 20° C. to about 25° C.) and is optionally washed to remove the surfactant. The toner is then optionally dried.

The toner particles of the present disclosure can be made to have the following physical properties when no external additives are present on the toner particles.

The toner particles can have a surface area, as measured by the well known BET method, of about 1.3 to about 6.5 $m^2/g$. For example, for cyan, yellow and black toner particles, the BET surface area can be less than 2 $m^2/g$, such as from about 1.4 to about 1.8 $m^2/g$, and for magenta toner, from about 1.4 to about 6.3 $m^2/g$.

It is also desirable to control the toner particle size and limit the amount of both fine and coarse toner particles in the toner. In an embodiment, the toner particles have a very narrow particle size distribution with a lower number ratio geometric standard deviation (GSD) of approximately 1.15 to approximately 1.30, or approximately less than 1.25. The toner particles of the present disclosure also can have a size such that the upper geometric standard deviation (GSD) by volume is in the range of from about 1.15 to about 1.30, such as from about 1.18 to about 1.22, or less than 1.25. These GSD values for the toner particles of the present disclosure indicate that the toner particles are made to have a very narrow particle size distribution.

Shape factor is also a control process parameter associated with the toner being able to achieve optimal machine performance. The toner particles can have a shape factor of about 105 to about 170, such as about 110 to about 160, SF1*a. Scanning electron microscopy (SEM) is used to determine the shape factor analysis of the toners by SEM and image analysis (IA) is tested. The average particle shapes are quantified by employing the following shape factor (SF1*a) formula: $SF1*a=100\pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area. In addition to measuring shape factor SF, another metric to measure particle circularity is being used on a regular bases. This is a faster method to quantify the particle shape. The instrument used is an FPIA-2100 manufactured by Sysmex. For a completely circular sphere the circularity would be 1.000. The toner particles can have circularity of about 0.920 to 0.990 and, such as from about 0.940 to about 0.980.

In addition to the foregoing, the toner particles of the present disclosure also have the following rheological and flow properties. First, the toner particles can have the following molecular weight values, each as determined by gel permeation chromatography (GPC) as known in the art. The binder of the toner particles can have a weight average molecular weight, Mw of from about 15,000 daltons to about 90,000 daltons.

Overall, the toner particles in embodiments have a weight average molecular weight (Mw) in the range of about 17,000 to about 60,000 daltons, a number average molecular weight (Mn) of about 9,000 to about 18,000 daltons, and a MWD of about 2.1 to about 10. MWD is a ratio of the Mw to Mn of the toner particles, and is a measure of the polydispersity, or width, of the polymer. For cyan and yellow toners, the toner particles in embodiments can exhibit a weight average molecular weight (Mw) of about 22,000 to about 45,000 daltons, a number average molecular weight (Mn) of about 9,000 to about 13,000 daltons, and a MWD of about 2.2 to about 10. For black and magenta, the toner particles in embodiments can exhibit a weight average molecular weight (Mw) of about 22,000 to about 45,000 daltons, a number average molecular weight (Mn) of about 9,000 to about 13,000 daltons, and a MWD of about 2.2 to about 10.

Further, the toners if desired can have a specified relationship between the molecular weight of the latex binder and the molecular weight of the toner particles obtained following the emulsion aggregation procedure. As understood in the art, the binder undergoes crosslinking during processing, and the extent of crosslinking can be controlled during the process. The relationship can best be seen with respect to the molecular peak values for the binder. Molecular peak is the value that represents the highest peak of the weight average molecular weight. In the present disclosure, the binder can have a molecular peak (Mp) in the range of from about 22,000 to about 30,000 daltons, such as from about 22,500 to about 29,000 daltons. The toner particles prepared from such binder also exhibit a high molecular peak, for example of about 23,000 to about 32,000, such as about 23,500 to about 31,500 daltons, indicating that the molecular peak is driven by the properties of the binder rather than another component such as the colorant.

The toner particles can be blended with external additives following formation. Any suitable surface additives may be used in embodiments. Most suitable are one or more of $SiO_2$, metal oxides such as, for example, $TiO_2$ and aluminum oxide, and a lubricating agent such as, for example, a metal salt of a fatty acid (e.g., zinc stearate (ZnSt), calcium stearate) or long chain alcohols such as UNILIN 700, as external surface additives. In general, silica is applied to the toner surface for toner flow, tribo enhancement, admix control, improved development and transfer stability and higher toner blocking temperature. $TiO_2$ is applied for improved relative humidity (RH) stability, tribo control and improved development and transfer stability. Zinc stearate is optionally also used as an external additive for the toners of the disclosure, the zinc stearate providing lubricating properties. Zinc stearate provides developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. In embodiments, a commercially available zinc stearate known as Zinc Stearate L, obtained from Ferro Corporation, can be used. The external surface additives can be used with or without a coating.

In embodiments, the toners contain from, for example, about 0.1 to about 5 weight percent titania, about 0.1 to about 8 weight percent silica and about 0.1 to about 4 weight percent zinc stearate.

The toner particles of the disclosure can optionally be formulated into a developer composition by mixing the toner particles with carrier particles. Illustrative examples of carrier particles that can be selected for mixing with the toner composition prepared in accordance with the present disclosure include those particles that are capable of triboelectrically obtaining a charge of opposite polarity to that of the toner particles. Accordingly, in one embodiment the carrier particles may be selected so as to be of a negative polarity in order that the toner particles that are positively charged will adhere to and surround the carrier particles. Illustrative examples of such carrier particles include iron, iron alloys, steel, nickel, iron ferrites, including ferrites that incorporate strontium, magnesium, manganese, copper, zinc, and the like, magnetites, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles can be used with or without a coating, the coating generally being comprised of acrylic and methacrylic polymers, such as methyl methacrylate, acrylic and methacrylic copolymers with fluoropolymers or with monoalkyl or dialkylamines, fluoropolymers, polyolefins, polystyrenes, such as polyvinylidene fluoride resins, terpolymers of styrene, methyl methacrylate, and a silane, such as triethoxy silane, tetrafluoroethylenes, other known coatings and the like.

The carrier particles can be mixed with the toner particles in various suitable combinations. The toner concentration is usually about 2% to about 10% by weight of toner and about 90% to about 98% by weight of carrier. However, different toner and carrier percentages may be used to achieve a developer composition with desired characteristics.

Toners of the present disclosure can be used in electrostatographic (including electrophotographic) imaging methods. Thus for example, the toners or developers of the disclosure can be charged, such as triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll.

It is envisioned that the toners of the present disclosure may be used in any suitable procedure for forming an image with a toner, including in applications other than xerographic applications.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Example 1

In a 2 L glass reactor, 258 grams core latex, 80.3 grams magenta pigment dispersion PR122, 20.1 grams magenta pigment dispersion PR185 (from Sun Chemical), P725 Wax Dispersion 60 grams, 20 grams Snowtex-OL, 30 grams Snowtex-OS, and de-ionized water 670 grams were mixed by a homogenizer for 15 minutes at 20° C. The core latex was prepared by in-situ seeded semi-continuous emulsion copolymerization of styrene and n-butyl acrylate (BA) with functional monomer beta-CarboxyEthyl Acrylate (β-CEA) at 75° C. In a 300-Gallon jacketed stainless steel reactor with double P-4 impeller set at 50 rpm, 1.1 parts of Dowfax 2A1 (47% aq.), and parts of deionized water were charged in, and deaerated for 30 minutes while the temperature was raised to 75° C. A monomer emulsion was prepared by agitating a monomer mixture (630 parts of styrene, 140 parts of n-butyl acrylate, 23.2 parts of beta-CarboxyEthyl Acrylate (β-CEA) and 5.4 parts of chain transfer agent 1-dodecanethiol) with an aqueous solution (15.3 parts of Dowfax 2A1, and 368 parts of deionized water) at 100 rpm at room temperature. A 1 wt % of seed monomer emulsion was taken from the monomer emulsion and added into the reactor and was stirred for 8 minutes at 75° C. An initiator solution prepared from 11.6 parts of ammonium persulfate in 57 parts of deionized water was added over 20 minutes. Stirring continued for an additional 20 minutes to allow seed particle formation. The first half of the remaining monomer emulsion was fed into the reactor over 130 minutes. A latex core of particle 180 nm was formed at this point, with a Mw of 50 kg/mole (GPC).

After that, 6.5 parts of 1-dodecanethiol were added into the remaining monomer emulsion, and stirred at 100 rpm for 10 minutes. Then, the new monomer emulsion was fed into the reactor over 90 minutes. At the conclusion of the monomer feed, the emulsion was post-heated at 75° C. for 3 hours and then cooled. Passing a stream of nitrogen through the emulsion throughout the reaction deoxygenated the reaction system. This final latex has an average particle size of 220 nm, Mw of 35 kg/mole (GPC), and a Tg of 50° C., with 42 percent solids. This latex was very stable and sediment-free.

Then Si-PAC premix was added dropwise in 5 minutes. The Si-PAC was prepared by mixing 20 grams Snowtex-OL, 30 grams Snowtex-OS, with 0.13 grams poly(aluminum chloride) 100 w. After another 5 minutes homogenization, poly(aluminum chloride) 100 w 2.2 grams in 20.0 grams of 0.02N nitric acid was added dropwise in eight minutes. The resulted viscous mixture was continuously mixed by homogenizer for another 20 minutes. Then the mixture was stirred by a mechanical stirrer at 550 rpm, and the temperature of the mixture was raised to 50° C. in about 35 minutes. After the particles reach at 5.8 micron (Layson cell), 140 grams shell latex were added dropwise in 10 minutes. After particle size reached at 6.5 microns, the pH value of this solution was adjusted to 6.5 by 4% wt. sodium hydroxide solution and hold for 10 minutes. Then 0.4 grams VELTA® 262 coalescent agent was added in, and hold for another 20 minutes. Then, the temperature of the mixture was raised to 94° C. in 35 minutes, and the pH was adjusted to 4.5 by 0.3N nitric acid immediately. After stirring at 94° C. for 60 minutes, the mixture was cooled down to 53° C., and the pH was adjusted to 10 by 4% wt. sodium hydroxide as the temperature went to 20° C. After washing with de-ionized water, acid and DI-water, and dried at 45° C., the final toner product has a volume median particle size of 5.84 microns, with circularity 0.964, GSDv 1.232.

Comparative Example 1

A magenta toner particle was prepared using the same formulation and process conditions as the above Example 1, except that no coalescent agent was added, and a higher coalescence temperature (96° C.) and a longer coalescence time (4 hr) was used. The same circularity 0.963 was achieved after 4 hours, with a particle size of 5.81 microns, GSDv 1.251. More comparisons of the toner particles of Example 1 and Comparative Example 1 are listed in Table 1:

TABLE 1

Comparison of Magenta Parent Particle Properties

| | Example 1 | Comparative Example 1 |
|---|---|---|
| Coalescent | Velta ® 262 | None |
| Particle Size (um) | 5.84 | 5.81 |
| GSDv | 1.232 | 1.251 |
| Circularity | 0.964 | 0.963 |
| Coalescence Temp. (° C.) | 94 | 96 |
| Coalescence time (hr) | 1 | 4 |
| MFI (g/10 min) | 27.93 | 28.25 |
| BET (multi point) ($m^2/g$) | 1.68 | 2.42 |
| Tg(° C.) | 51.3 | 51.7 |

Comparing the standard emulsion aggregation process of Comparative Example 1 (without coalescence agent) and the process of Example 1 with a small amount of coalscence agent, the coalescence time needed was significantly reduced (only 1 hour coalescence for 0.964 magenta particle circularity, compared with 4~5 hours) at even lower coalescence temperature (94° C.). The resulted toner particles also show improved GSD and BET. However, the MFI and Tg are almost the same as the toner particle prepared without coalescence agent, indicating that the impact of the small amount of the coalescence agent added during the coalescence process is minimal on the toner properties.

Example 2

In a 2L reactor, core polystyrene-n-butyl acrylate latex 262 grams, pigment dispersion REGAL 330 carbon black 70.8 grams, P725 Wax Dispersion 55.6 grams, and de-ionized water 580 grams were mixed by a homogenizer for 15 minutes at 20° C. The shell latex was made in the same manner as above, with similar particle size, molecular weight, Tg and solids content.

Poly(aluminum chloride) 100 w 2.2 grams in 20.0 grams of 0.02N nitric acid was added dropwise in eight minutes. The resulted viscous mixture was continuously mixed by homogenizer for another 20 minutes. Then the mixture was stirred by a mechanical stirrer at 450 rpm, and the temperature of the mixture was raised to 50° C. in about 35 minutes. After the particles reach at 4.8 micron (Layson cell), 180 grams reactive latexes as prepared above were added dropwise in 20 minutes. After particle size reached at 6.0 microns, the pH value of this solution was adjusted to 6.5 by 4% wt. sodium hydroxide solution and hold for 10 minutes. Then 0.4 grams VELTA® 368 was added in, and hold for another 20 minutes. Then, the temperature of the mixture was raised to 94° C. in 35 minutes, and the pH was adjusted to 5.0 by 0.3N nitric acid immediately. After stirred at 94° C. for 1 hour, the mixture was cooled down to 58° C., and the pH was adjusted to 8.8 by 4% wt. sodium hydroxide as the temperature went to 20° C. After washing by a large amount of de-ionized water, and dried at 65° C., the final toner product has a volume median particle size of 5.98 microns, with circularity 0.976, GSDv 1.22.

Comparative Example 2

A magenta toner particle was prepared using the same formulation and process conditions as in Example 2, except that no coalescent was added, and a higher coalescence temperature (96° C.) and a longer coalescence time (2.5 hr) was used. The same circularity 0.96 was achieved after 2.5 hours, with a particle size of 5.95 microns, GSDv 1.231. More comparisons of the toner particles of Example 2 and Comparative Example 2 are listed in Table 2:

TABLE 1

Comparison of Black Parent Particle Properties

| | Example 2 | Comparative Example 2 |
|---|---|---|
| Coalescent | Velta ® 368 | None |
| Particle Size (um) | 5.98 | 5.95 |
| GSDv | 1.220 | 1.231 |
| Circularity | 0.976 | 0.960 |
| Coalescence Temp. (° C.) | 94 | 96 |
| Coalescence time (hr) | 1 | 2.5 |
| MFI (g/10 min) | 29.21 | 28.95 |

TABLE 1-continued

Comparison of Black Parent Particle Properties

| | Example 2 | Comparative Example 2 |
|---|---|---|
| BET (multi point) ($m^2/g$) | 1.42 | 1.49 |
| Tg (° C.) | 50.2 | 50.4 |

Similar to Example 1 and Comparatvie Example 1, comparison of the standard emulsion aggregation process of Comparative Example 2 (without coalescence agent) and the process of Example 2 with small amount of coalscence agent, the coalescence time needed was significantly reduced at even lower coalescence temperature (94° C.). The resulted toner particles also show improved GSD and BET. And the impact of the small amount of the coalescence agent added during the coalescence process is minimal on the toner properties, as suggested by the MFI and Tg data.

Example 3

206 grams core polystyrene-n-butyl acrylate latex was homogenized with 677 grams deionized water, 42 grams wax dispersion, 2 grams TEXANOL® available from Eastman Kodak, and 35.3 grams BK3 black pigment. The shell latex was made in the same manner as above, with similar particle size, molecular weight, Tg and solids content. During the homogenization, a solution of 2.6 grams polyaluminum chloride in 20 mL $HNO_3$ was added dropwise. The solution was heated to 52° C. where a size of 5.5 microns was achieved. At this size, a shell latex of 105 grams of the same core latex was slowly added and the temperature raised to 54° C. When the particle size reached 6 microns, the growth was halted by changing the pH of the solution to pH 7.5 through the addition of 1M NaOH. The temperature of the solution was raised to 93° C. at a ramp rate of 1° C./min. At 93° C., the pH of the solution was changed to pH 3.7 and the coalescence of the particles was followed using microscopy for 16 hours.

Comparative Example 3

206 grams core latex was homogenized with 677 grams deionized water, 42 grams wax dispersion, and 35.3 grams BK3 black pigment. During the homogenization, a solution of 2.6 grams polyaluminum chloride in 20 mL $HNO_3$ was added dropwise. The solution was heated to 52° C. where a size of 5.5 microns was achieved. At this size, a shell latex of 105 grams of the same core latex was slowly added and the temperature raised to 54° C. When the particle size reached 6 microns, the growth was halted by changing the pH of the solution to pH 7.5 through the addition of 1M NaOH. The temperature of the solution was raised to 93° C. at a ramp rate of 1° C./min. At 93° C., the pH of the solution was changed to pH 3.7 and the coalescence of the particles was followed using microscopy for 16 hours.

In the toner prepared using TEXANOL® (Example 3), full coalescence to a spherical shape was achieved prior to the temperature reaching 93° C. In contrast, in the case of the control (Comparative Example 3), 16 hours at 93° C. was required for the preparation of comparable spherical toners.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A process for preparing a toner, comprising:

mixing a polymeric resin emulsion, a colorant dispersion, and a wax to form a mixture;

optionally adding a coagulant to said mixture;

heating the mixture at a temperature below a glass transition temperature of said polymeric resin to aggregate said polymeric resin, colorant, and wax, to form aggregated particles;

adding a coalescent agent to said aggregated particles, the coalescent agent being selected from the group consisting of benzoic acid alkyl esters, ester-alcohols, glycol-ether type solvents, long-chain aliphatic alcohols, aromatic alcohols, and mixtures thereof;

heating the aggregated particles and coalescent agent at a temperature above the glass transition temperature of said polymeric resin, to coalesce said aggregated particles to form toner particles, optionally cooling the mixture; and isolating the toner particles.

2. The process of claim 1, further comprising:

adding an organic or an inorganic acid to said mixture before heating the mixture at a temperature below the glass transition temperature of said polymeric resin; and adding a base to said aggregated particles before heating the mixture at a temperature above the glass transition temperature of said polymeric resin.

3. The process of claim 2, wherein said base is added before the coalescent agent is added to said aggregated particles.

4. The process of claim 1, wherein the coalescent agent comprises a benzoic acid alkyl ester selected from the group consisting of decyl or isodecyl benzoate, nonyl or isononyl benzoate, octyl or isooctyl benzoate, 2-ethylhexyl benzoate, tridecyl or isotridecyl benzoate, 3,7-dimethyloctyl benzoate, 3,5,5-trimethylhexyl benzoate, and mixtures thereof.

5. The process of claim 1, wherein the coalescent agent comprises an ester-alcohol that is a hydroxyalkyl ester of alkanoic acids where the alkyl groups, which can be straight or branched, substituted or unsubstituted, independently have from about 2 to about 30 carbon atoms.

6. The process of claim 1, wherein the coalescent agent comprises a glycol-ether solvent selected from the group consisting of diethylene glycol monomethylether acetate, diethylene glycol monobutylether acetate, butyl carbitol acetate, and mixtures thereof.

7. The process of claim 1, wherein the coalescent agent comprises a long-chain aliphatic alcohol, wherein the alkyl group is from about 5 to about 20 carbon atoms.

8. The process of claim 1, wherein the coalescent agent evaporates during subsequent processing, such that the toner particles are substantially free of the coalescent agent.

9. The process of claim 1, wherein the coalescent agent has solubility in water of below about 0.5 weight %.

10. The process of claim 1, wherein the toner particles have a particle size distribution with a lower number ratio geometric standard deviation of about 1.15 to about 1.30, and a size such that the upper geometric standard deviation by volume is from about 1.15 to about 1.30.

11. The process of claim 1, wherein the coalescent agent is added in an amount of from about 0.01 to about 10 percent by weight, based on the solids content in the mixture.

12. The process of claim 1, wherein the coalescent agent is added in an amount of from about 0.1 to about 0.5 percent by weight, based on the solids content in the mixture.

13. The process of claim 1, wherein the heating of the aggregated particles and coalescent agent is conducted for about 15 minutes to about 2 hours.

14. The process of claim 1, wherein the heating of the aggregated particles and coalescent agent is conducted for about 30 minutes to about 90 minutes.

15. The process of claim 1, wherein the heating of the mixture is at a temperature from about 45° C. to about 60° C. and the heating of the aggregated particles and coalescent agent is at a temperature from about 80° C. to about 95° C.

16. The process of claim 1, wherein the polymeric resin is a polyester resin.

17. The process of claim 1, wherein the polymeric resin is selected from the group consisting of polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-sebacate, polypropylene sebacate, polybutylene-sebacate, polyethylene-adipate, polypropylene-adipate, polybutylene-adipate, polypentylene-adipate, polyhexalene-adipate, polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate polyethylene-pimelate, polypropylene-pimelate, polybutylene-pimelate, polypentylene-pimelate, polyhexalene-pimelate, polyheptadene-pimelate, poly (propoxylated bisphenol-fumarate), poly(propoxylated bisphenol- succinate), poly(propoxylated bisphenol-adipate), poly(propoxylated bisphenol-glutarate), sulfonated forms of the preceding resins, and mixtures thereof.

18. The process of claim 1, wherein the polymeric resin is selected from the group consisting of alkali copoly(5-sulfoisophthaloyl)-co-poly(ethylene-adipate), alkali copoly(5-sulfoisophthaloyl)-copoly(propylene-adipate), alkali copoly (5-sulfoisophthaloyl)-copoly-(butylene-adipate), alkali copoly(5-sulfo-isophthaloyl)-copoly(pentylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-co-poly (butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly (5-sulfoisophthaloyl)-copoly(ethylene-succinate), alkali copoly(5-sulfoisophthaloyl-copoly(butylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly (propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly (pentylene-adipate), alkali copoly(5-sulfo-isophthaloyl) copoly(hexylene-adipate), and poly(octylene-adipate).

19. The process of claim 1, wherein the polymeric resin is selected from the group consisting of styrene acrylates, styrene methacrylates, butadienes, isoprene, acrylonitrile, acrylic acid, methacrylic acid, beta-carboxy ethyl acrylate, polyesters, poly(styrene-butadiene), poly(methyl styrene-butadiene), poly(methyl methacrylate-butadiene), poly(ethyl methacrylate-butadiene), poly(propyl methacrylate-butadiene), poly(butyl methacrylate- butadiene), poly(methyl acrylate-butadiene), poly(ethyl acrylate-butadiene), poly(propyl acrylate-butadiene), poly(butyl acrylate-butadiene), poly (styrene-isoprene), poly(methyl styrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and styrene/butyl acrylate/carboxylic acid terpolymers, and mixtures thereof.

20. The process of claim 1, wherein the coagulant is present in the toner particles, exclusive of any optional external additives, and on a dry weight basis, in an amount of from 0 to about 5% by weight of the toner particles and is selected from the group consisting of polyaluminum halides, polyaluminum silicates, polyaluminum hydroxides, and polyaluminum phosphate.

21. The process of claim 1, wherein the wax is an alkylene wax present in an amount of about 5% to about 15% by weight based upon the total weight of the composition.

22. The process of claim 19, wherein the wax is a polyethylene wax, a polypropylene wax, or mixtures thereof.

23. The process of claim 1, wherein the colorant comprises a pigment, a dye, or mixtures thereof, in an amount of about 1% to about 25% by weight based upon the total weight of the composition.

* * * * *